US011787582B2

(12) United States Patent
Itagaki

(10) Patent No.: US 11,787,582 B2
(45) Date of Patent: Oct. 17, 2023

(54) BINDING MACHINE

(71) Applicant: MAX CO., LTD., Tokyo (JP)

(72) Inventor: Osamu Itagaki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 17/873,790

(22) Filed: Jul. 26, 2022

(65) Prior Publication Data

US 2023/0030329 A1 Feb. 2, 2023

(30) Foreign Application Priority Data

Jul. 30, 2021 (JP) ..... 2021-126176

(51) Int. Cl.
*B65B 13/28* (2006.01)
*B65B 13/02* (2006.01)
*B65B 13/08* (2006.01)

(52) U.S. Cl.
CPC ..... *B65B 13/285* (2013.01); *B65B 13/025* (2013.01); *B65B 13/08* (2013.01)

(58) Field of Classification Search
CPC ..... B21F 15/00; B21F 15/02; B21F 15/04; B25B 25/00; B65B 13/22; B65B 13/28; B65B 13/285; B65B 13/025; B65B 13/04; B65B 13/06; B65B 27/10; E04G 21/123
See application file for complete search history.

(56) References Cited

U.S. PATENT DOCUMENTS 5,657,799 A * 8/1997 Kusakari ..... E04G 21/123 140/57
2019/0093374 A1 3/2019 Machida et al.

FOREIGN PATENT DOCUMENTS

JP H0913677 A * 6/1995 ..... E04G 21/123
JP 2949703 B2 9/1999
JP 6887760 B2 6/2021

OTHER PUBLICATIONS

Translation of JP-H0913677 (Year: 1995).*

* cited by examiner

*Primary Examiner* — Bobby Yeonjin Kim
(74) *Attorney, Agent, or Firm* — WEIHROUCH IP

(57) ABSTRACT

A binding machine includes a wire feeding unit, a binding unit configured to rotate while locking the wire wound around the reinforcing bars, whereby to twist the wire, a curl guide configured to curl the fed wire, a leading guide configured to lead the curled wire to the binding unit, and a contact switch unit configured to be activated with the reinforcing bars abutting against the contact switch unit, in which the contact switch unit includes an abutting portion against which the reinforcing bars abut, and the abutting portion is provided between the curl guide and the leading guide and is provided on at least one side relative to an axis of rotation operation of the binding unit in a direction perpendicular to both a direction in which the curl guide and the leading guide are arranged.

6 Claims, 13 Drawing Sheets

BINDING MACHINE

CROSS-REFERENCE TO RELATED APPLICATIONS

This application claims priority to Japanese Patent Application No. 2021-126176 filed on Jul. 30, 2021, the content of which is incorporated herein by reference.

TECHNICAL FIELD

The present invention relates to a binding machine for binding an object to be bound, such as a reinforcing bar, with a wire.

BACKGROUND ART

Commonly, a binding machine called a reinforcing bar binding machine has been proposed in which a wire is wound around two or more reinforcing bars, the wire wound around the reinforcing bars is twisted, and the two or more reinforcing bars are bound by the wire.

In the binding machine, a wire fed by a driving force of a motor is wound around the reinforcing bars by passing the wire through a guide which is called a curl guide and which curls the wire. The curled wire is led to a binding unit, which twists the wire, by a guide referred to as a leading guide, and the wire wound around the reinforcing bars is twisted by the binding unit, so that the reinforcing bars are bound by the wire.

A binding machine has been proposed, and the binding machine executes a binding operation not only by a trigger switch unit provided in a handle portion but also by detecting that a member called a contact member abuts against a member in the vicinity of a portion where reinforcing bars are disposed, or the reinforcing bars.

In the configuration of detecting that the contact member abuts against the member in the vicinity of the portion where the reinforcing bars are disposed, a part of the contact member protrudes from a guide protruding forward in the guide for curling the wire or the guide for leading the curled wire. In addition, a configuration has been proposed in which the contact member is activated such that a distal end of the guide abuts against the member in the vicinity of the portion where the reinforcing bars are disposed (see, for example, JP 2949703 B).

Further, the configuration of detecting that the contact member abuts against the reinforcing bars includes a contact member movable in a direction approaching the guide is provided on one of the guide for curling the wire and the guide for leading the curled wire. In addition, a configuration has been proposed in which the contact member is activated such that the reinforcing bars abut against the guide (see, for example, JP 6887760 B).

In the configuration in which the contact member is activated such that the distal end of the guide abuts against the member in the vicinity of the portion where the reinforcing bars are disposed, the binding operation is executed even when a distance between the reinforcing bars and the binding unit for twisting the reinforcing bars is long, and thus a gap is likely to be generated between the reinforcing bars and the wire, and the binding force is weakened.

In addition, in the configuration in which the contact member is activated such that the reinforcing bars abut against the guide, the position where the wire is twisted by the binding unit is deviated from the reinforcing bars, a gap is likely to be generated between the reinforcing bar and the wire, and the binding force is weakened.

The present invention has been made to solve such a problem, and an object thereof is to provide a binding machine that can ensure binding strength.

SUMMARY OF INVENTION

According to an aspect of the invention, there is provided a binding machine. The binding machine includes: a body portion, the body portion includes: a wire feeding unit configured to feed a wire wound around an object to be bound, a binding unit configured to rotate while locking the wire wound around the object, whereby to twist the wire, a curl guide configured to curl the wire fed by the wire feeding unit, a leading guide configured to lead the wire curled by the curl guide to the binding unit, and a contact switch unit configured to be activated when the object abuts against the contact switch unit, in which the curl guide and the leading guide are provided at one end portion of the body portion in a direction along an axis of a rotation operation of the binding unit, the contact switch unit includes an abutting portion against which the object abuts, the abutting portion is provided between the curl guide and the leading guide, and is provided on at least one side relative to the axis in a direction perpendicular to both a direction in which the curl guide and the leading guide are arranged and the direction along the axis, a protruding amount from the one end portion of the body portion to a front end of the abutting portion along the axis is smaller than at least one of a protruding amount from the one end portion of the body portion to a front end of the curl guide along the axis and a protruding amount of the one end portion of the body portion to a front end of the leading guide along the axis, and a binding operation is executed in response to activation of the contact switch unit brought by abutment of the object against the abutting portion.

In the present invention, when the object to be bound is abutted against the abutting portion, the contact switch unit is activated to execute the binding operation.

In the present invention, the binding operation can be executed in a state in which the object to be bound is positioned on an extension line of the axis of the rotation operation of the binding unit or in a vicinity of the extension line. The abutting portion does not protrude from the curl guide and the leading guide. Therefore, a structure located further forward than the curl guide and the leading guide is prevented from coming into contact with the abutting portion and the contact switch unit is prevented from being activated, and the binding operation can be performed in a state in which the object to be bound is positioned on the extension line of the axis of the rotation operation of the binding unit or in the vicinity of the extension line. Accordingly, a position of the object to be bound is prevented from being greatly deviated from a position where the wire is twisted, and the binding strength can be ensured.

DESCRIPTION OF EMBODIMENTS

Hereinafter, an example of a reinforcing bar binding machine as an embodiment of a binding machine of the present invention will be described with reference to the drawings.

Figure 1:
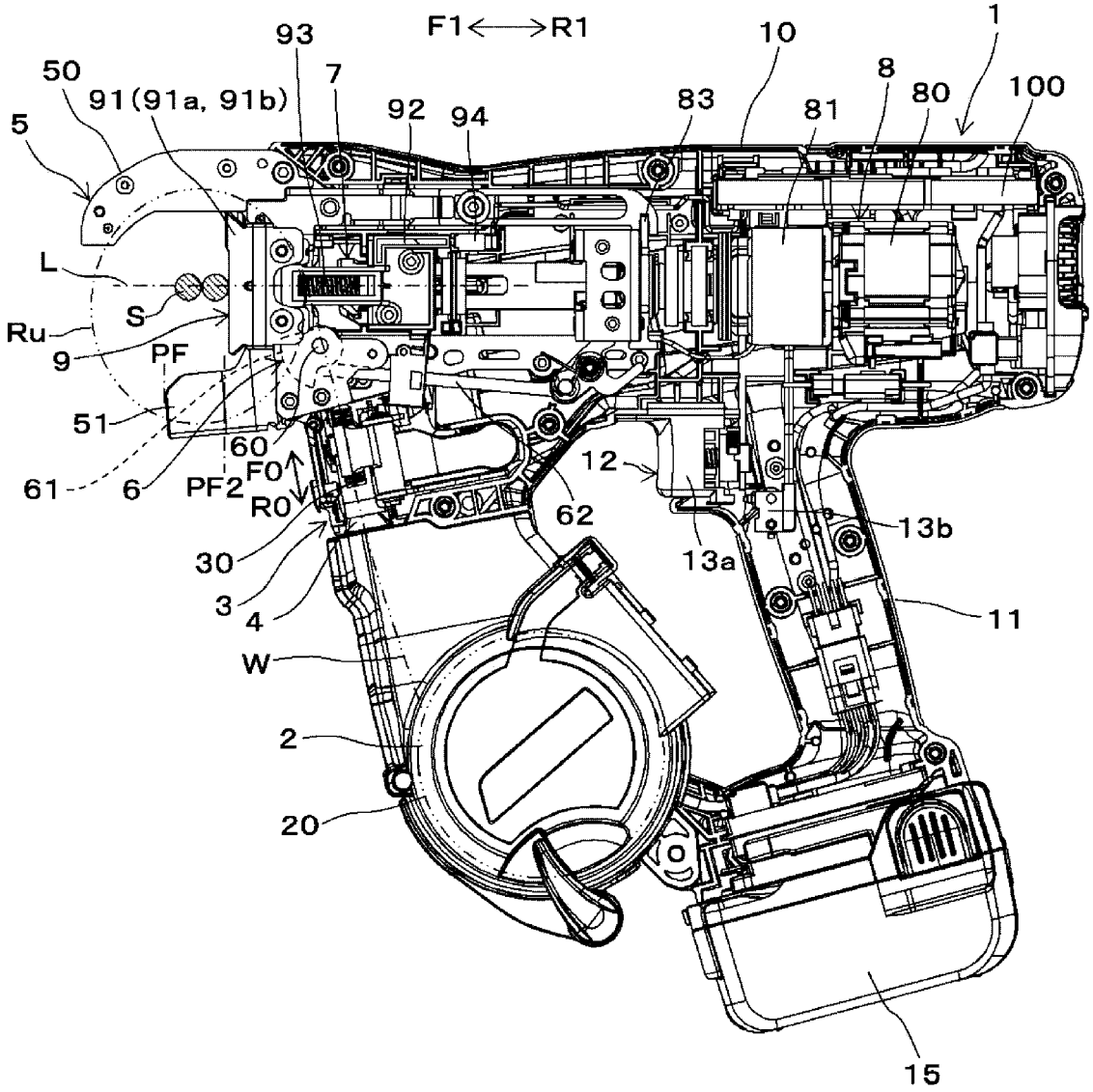
FIG. 1 is an internal configuration diagram illustrating an example of an overall configuration of a reinforcing bar binding machine according to the present embodiment when viewed from a side surface.
Figure 2A:
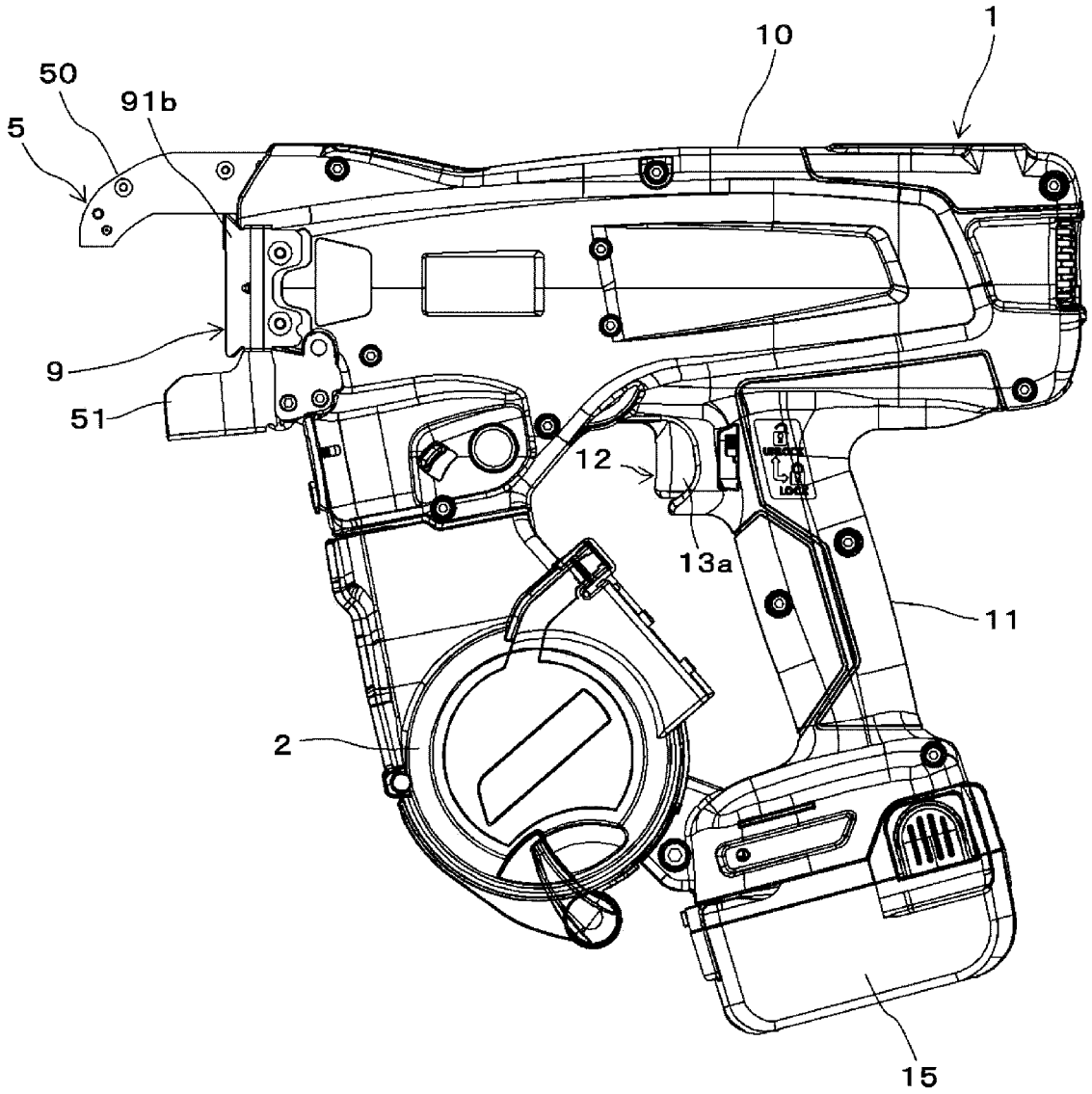
FIG. 2A is a side view illustrating an example of the overall configuration of the reinforcing bar binding machine according to the present embodiment.
Figure 2B:
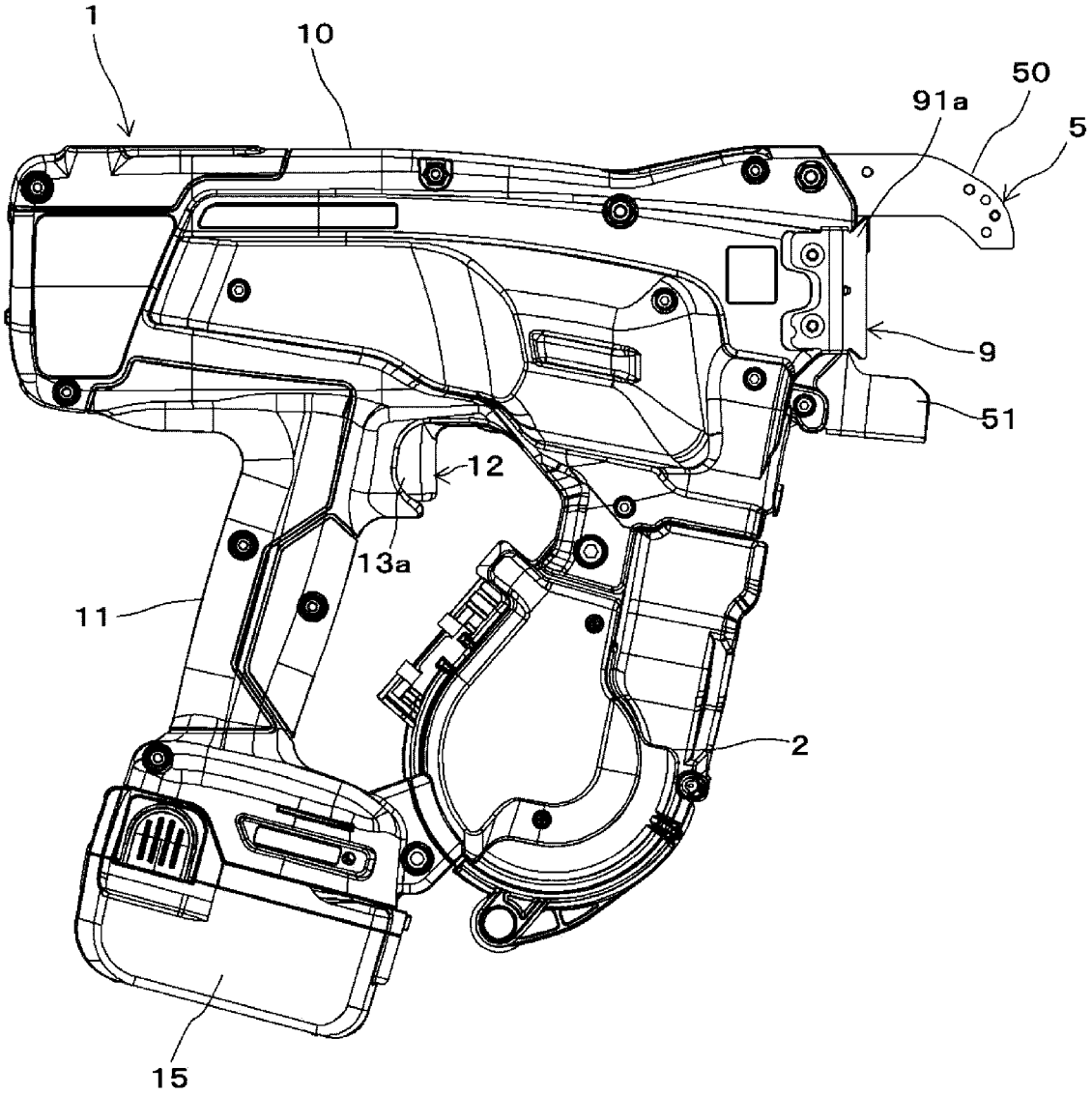
FIG. 2B is a side view illustrating an example of the overall configuration of the reinforcing bar binding machine according to the present embodiment.
Figure 2C:
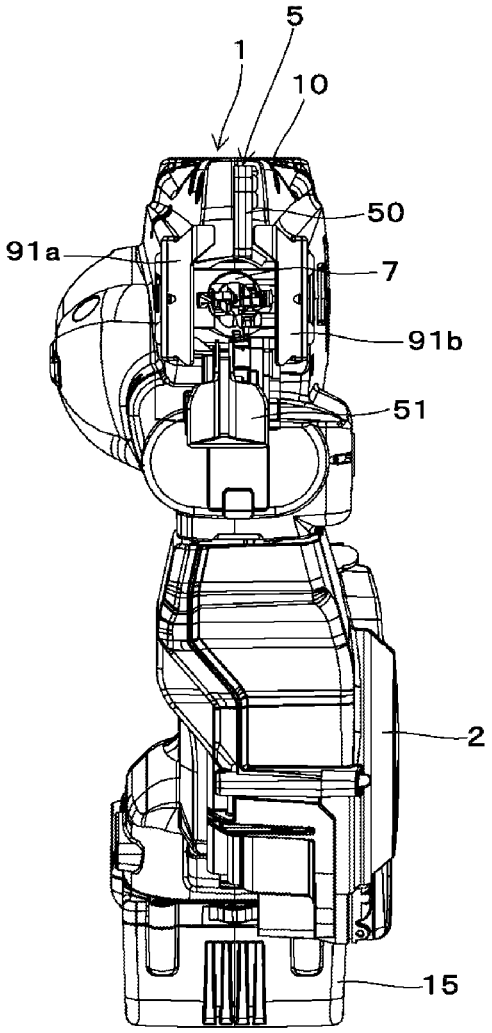
FIG. 2C is a front view illustrating an example of the overall configuration of the reinforcing bar binding machine according to the present embodiment.
Figure 2D:
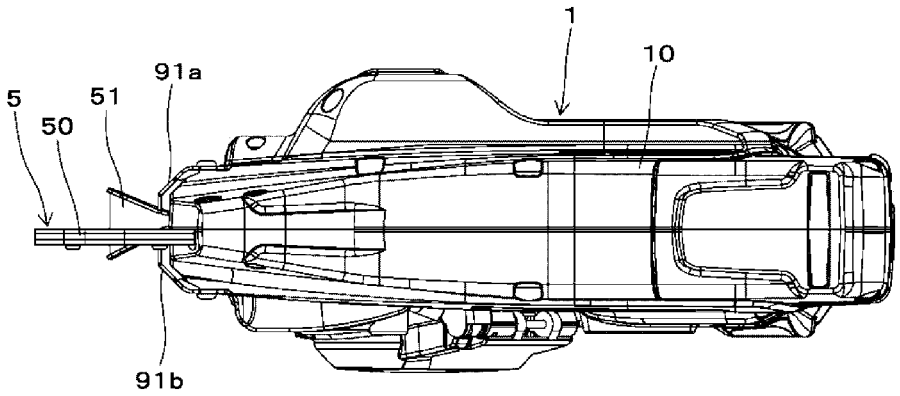
FIG. 2D is a top view illustrating an example of the overall configuration of the reinforcing bar binding machine according to the present embodiment.

Configuration Example of Reinforcing Bar Binding Machine of Present Embodiment FIG. 1 is an internal configuration diagram illustrating an example of an overall configuration of a reinforcing bar binding machine according to the present embodiment when viewed from a side surface. FIGS. 2A and 2B are side views illustrating an example of the overall configuration of the reinforcing bar binding machine according to the present embodiment, FIG. 2C is a front view illustrating an example of the overall configuration of the reinforcing bar binding machine according to the present embodiment, and FIG. 2D is a top view illustrating an example of the overall configuration of the reinforcing bar binding machine according to the present embodiment.

Figure 3A:
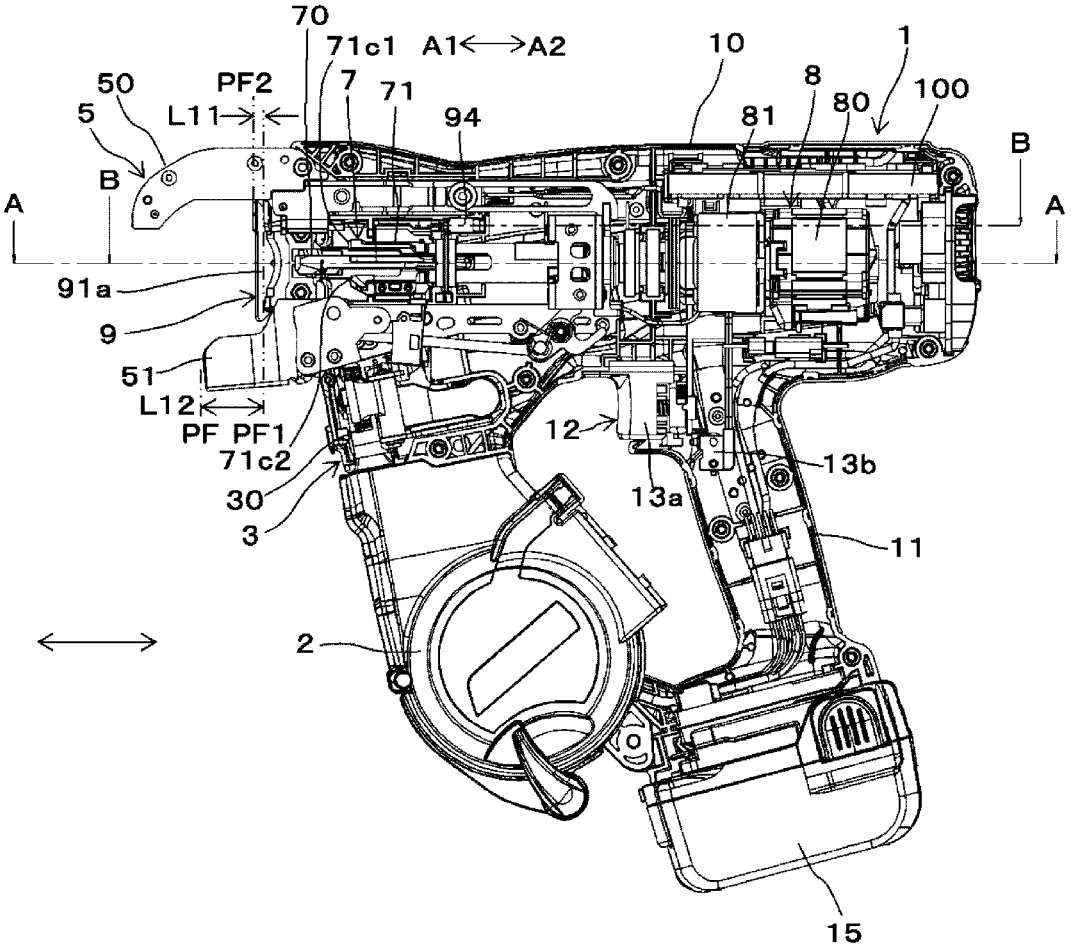
FIG. 3A is an internal configuration diagram illustrating an example of the overall configuration of the reinforcing bar binding machine according to the present embodiment when viewed from a side surface.
Figure 3B:
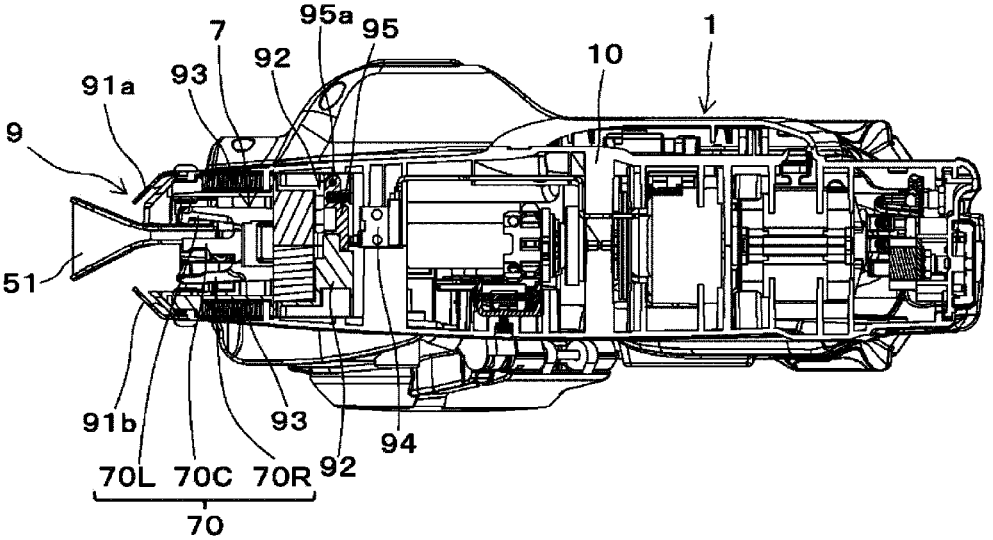
FIG. 3B is a cross-sectional view taken along a line A-A in FIG. 3A.
Figure 3C:
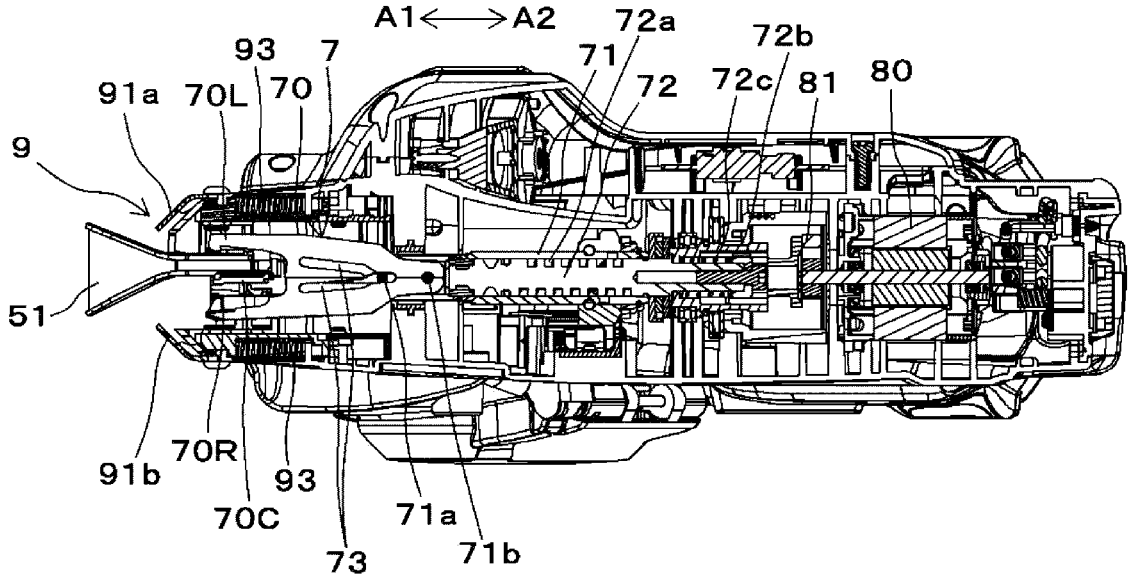
FIG. 3C is a cross-sectional view taken along a line B-B in FIG. 3A.
Figure 4A:
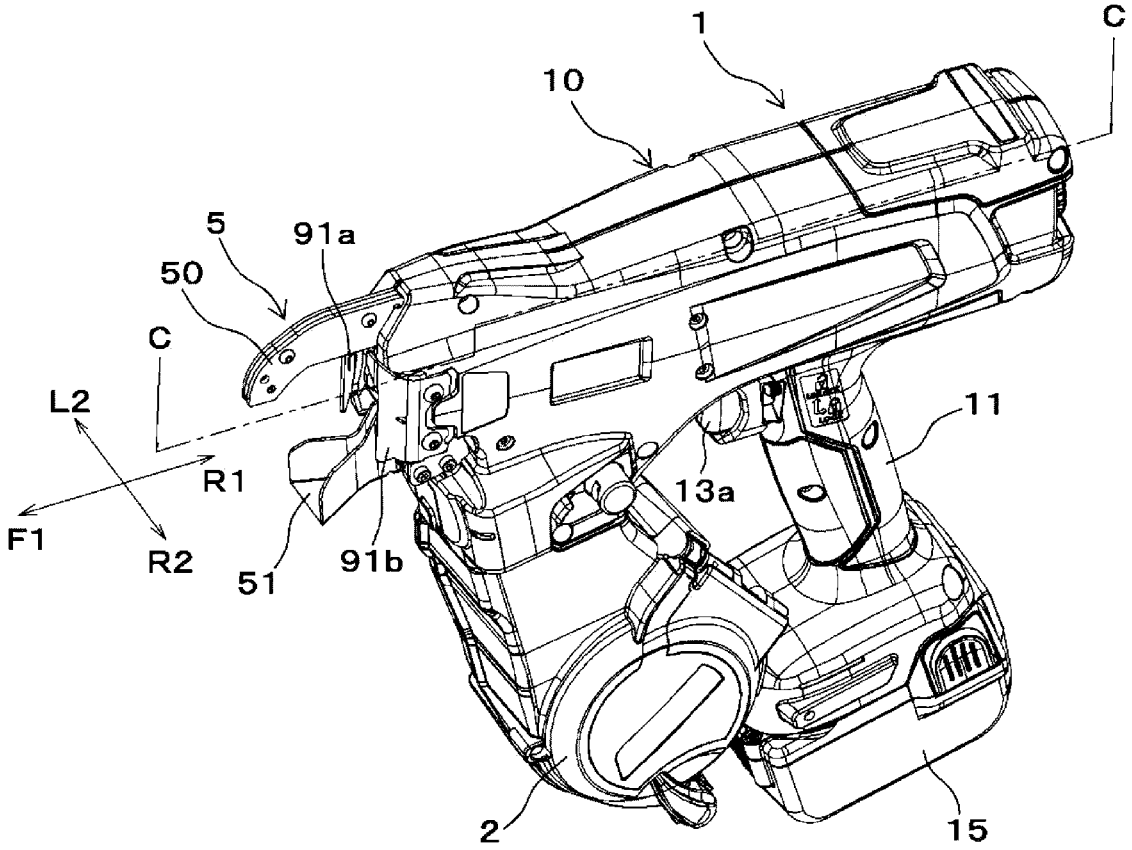
FIG. 4A is a perspective view illustrating an example of the overall configuration of the reinforcing bar binding machine according to the present embodiment.
Figure 4B:
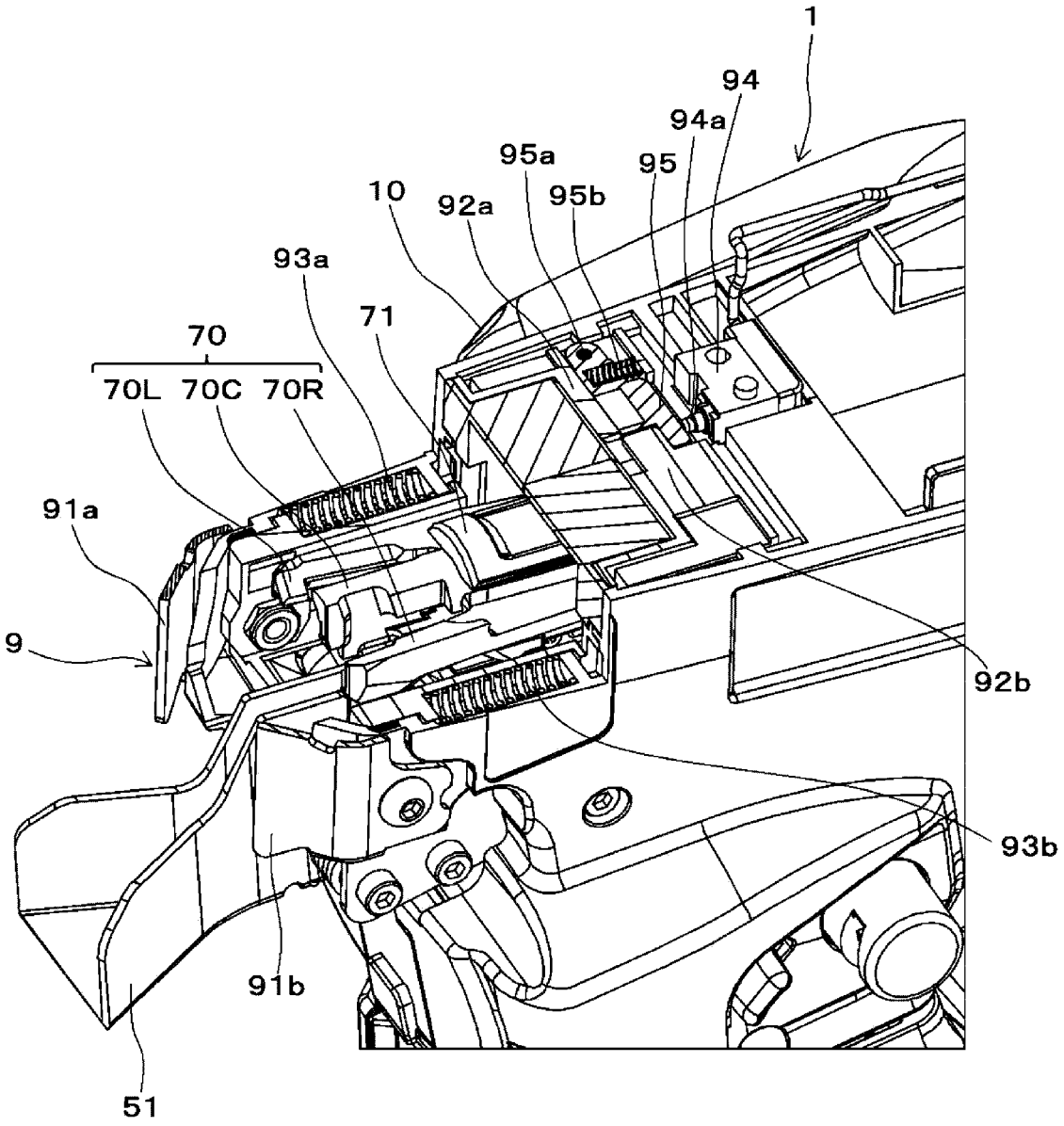
FIG. 4B is a cross-sectional view of a main part taken along a line C-C in FIG. 4A.

FIG. 3A is an internal configuration diagram illustrating an example of the overall configuration of the reinforcing bar binding machine according to the present embodiment when viewed from a side surface, FIGS. 3B and 3C are cross-sectional views illustrating an example of the overall configuration of the reinforcing bar binding machine according to the present embodiment when viewed from an upper surface, FIG. 3B is a cross-sectional view taken along a line A-A in FIG. 3A, and FIG. 3C is a cross-sectional view taken along a line B-B in FIG. 3A. FIG. 4A is a perspective view illustrating an example of the overall configuration of the reinforcing bar binding machine according to the present embodiment, and FIG. 4B is a main-part cross-sectional view taken along a line C-C in FIG. 4A.

A reinforcing bar binding machine 1 feeds a wire W in a normal direction indicated by an arrow F0 and winds the wire W around reinforcing bars S that are an object to be bound, followed by feeding the wire W wound around the reinforcing bars S in a reverse direction indicated by an arrow R0 and winding the wire W around the reinforcing bars S and cutting the wire W, and then twists the wire W and binds the reinforcing bars S with the wire W.

In order to implement the above-described functions, the reinforcing bar binding machine 1 includes a magazine 2 in which the wire W is accommodated, and a wire feeding unit 3 that feeds the wire W. The reinforcing bar binding machine 1 further includes a curl forming unit 5 constituting a path through which the wire W fed by the wire feeding unit 3 is wound around the reinforcing bars S, and a cutting unit 6 that cuts the wire W wound around the reinforcing bars S. The reinforcing bar binding machine 1 further includes a binding unit 7 that twists the wire W wound around the reinforcing bars S, and a drive unit 8 that drives the binding portion 7.

In addition, the reinforcing bar binding machine 1 is used by being held in a hand of an operator, and includes a body portion 10 and a handle portion 11.

The reinforcing bar binding machine 1 includes a trigger switch unit 12 that is activated by an operation of a hand gripping the handle portion 11, and a contact switch unit 9 that is actuated by abutting against the reinforcing bars S. When the trigger switch unit 12 is activated and the contact switch unit 9 is activated, the reinforcing bar binding machine 1 executes a binding operation. When the contact switch unit 9 is activated in a state in which the trigger switch unit 12 has been activated, the reinforcing bar binding machine 1 may execute the binding operation. When the trigger switch unit 12 is activated in a state in which the contact switch unit 9 has been activated, the reinforcing bar binding machine 1 may execute the binding operation. Further, the reinforcing bar binding machine 1 may not include the trigger switch unit 12, and may execute the binding operation when the contact switch unit 9 is activated.

The magazine 2 is an example of an accommodation portion, and a reel 20 is rotatably and detachably accommodated therein. The wire W with an elongated shape is wound around the reel 20 so as to be delivered out. As the wire W, a wire formed of a plastically deformable metal wire, a wire obtained by coating a metal wire with a resin, or a twisted wire is used.

The wire feeding unit 3 includes a pair of feed gears 30 that hold and feed one wire or a plurality of wires W arranged in parallel, and a feed motor (not illustrated) that drives the feed gears 30. In the wire feeding unit 3, a rotation operation of the feed motor is transmitted via a transmission mechanism, and the feed gear 30 rotates.

The wire feeding unit 3 feeds the wire W held between the pair of feed gears 30 along an extending direction of the wire W. In a configuration in which a plurality of, for example, two wires W are fed, the wires W are fed in a state in which the two wires W are arranged in parallel.

In the wire feeding unit 3, a rotation direction of the feed gear 30 is switched by switching a normal rotation direction and a reverse rotation direction of the feed motor, and a feeding direction of the wire W is switched between a normal direction that is one direction and a reverse direction that is another direction opposite to the one direction.

Wire guides 4 are provided at predetermined positions on an upstream side and a downstream side of the wire feeding unit 3 relative to a feeding direction in which the wire W is fed in the normal direction. In the configuration in which two wires W are fed, the wire guide 4 restricts directions of the two wires W in a radial direction, and guides the two wires W, which have entered, between the pair of feed gears 30 in parallel.

The curl forming unit 5 includes a curl guide 50 that curls the wire W fed by the wire feeding unit 3, and a leading guide 51 that leads the wire W curled by the curl guide 50 to the binding unit 7. In the reinforcing bar binding machine 1, a path of the wire W fed by the wire feeding unit 3 is restricted by the curl forming unit 5, so that a trajectory of the wire W becomes a loop Ru as indicated by a two-dot chain line in FIG. 1, and the wire W is wound around the reinforcing bars S.

The cutting unit 6 includes a fixed blade portion 60, a movable blade portion 61 that cuts the wire W in cooperation with the fixed blade portion 60, and a transmission mechanism 62 that transmits the operation of the binding unit 7 to the movable blade portion 61. The cutting unit 6 cuts the wire W by rotating the movable blade portion 61 about the fixed blade portion 60 serving as a fulcrum axis.

The binding unit 7 includes a wire locking body 70 to which the wire W is locked, and a rotation shaft 72 that activates the wire locking body 70. The drive unit 8 includes a motor 80 and a reduction gear 81 that reduces a speed and amplifies a torque. In the binding unit 7 and the drive unit 8, the rotation shaft 72 and the motor 80 are coupled to each other via the reduction gear 81, and the rotation shaft 72 is driven by the motor 80 via the reduction gear 81.

The wire locking body 70 includes a center hook 70C coupled to the rotation shaft 72, a first side hook 70R and a second side hook 70L that are opened and closed relative to the center hook 70C, and a sleeve 71 that activates the first side hook 70R and the second side hook 70L in conjunction with the rotation operation of the rotation shaft 72.

In the binding unit 7, a side on which the center hook 70C, the first side hook 70R, and the second side hook 70L are provided is defined as a front side, and a side on which the rotation shaft 72 is connected to the reduction gear 81 is defined as a rear side.

The center hook 70C is coupled to a front end, which is one end portion of the rotation shaft 72, via a configuration that is rotatable relative to the rotation shaft 72 and is movable in an axial direction integrally with the rotation shaft 72.

A distal end side of the first side hook 70R, which is one end portion along the axial direction of the rotation shaft 72, is located on one side portion of the center hook 70C. A rear end side of the first side hook 70R, which is the other end portion along the axial direction of the rotation shaft 72, is rotatably supported by the center hook 70C via a shaft 71*b*.

A distal end side of the second side hook 70L, which is one end portion along the axial direction of the rotation shaft 72, is located at the other side portion of the center hook 70C. A rear end side of the second side hook 70L, which is the other end portion along the axial direction of the rotation shaft 72, is rotatably supported by the center hook 70C via the shaft 71*b*.

Accordingly, the wire locking body 70 is opened and closed in a direction in which the distal end side of the first side hook 70R is separated from and brought into contact with the center hook 70C by a rotation operation with the shaft 71*b* serving as a fulcrum. Further, the wire locking body 70 is opened and closed in a direction in which the distal end side of the second side hook 70L is separated from and brought into contact with the center hook 70C.

The sleeve 71 has a tubular shape covering a periphery of the rotation shaft 72, and includes a convex portion (not illustrated) protruding from an inner peripheral surface of a tubular space into which the rotation shaft 72 is inserted. The convex portion enters a groove portion of a feed screw 72*a* formed along the axial direction on an outer periphery of the rotation shaft 72. When the rotation shaft 72 rotates, the sleeve 71 moves in a front-rear direction, which is a direction along the axial direction of the rotation shaft 72, in accordance with the rotation direction of the rotation shaft 72 by an action between the convex portion (not illustrated) and the feed screw 72*a* of the rotation shaft 72. The sleeve 71 rotates integrally with the rotation shaft 72.

The sleeve 71 includes an opening-closing pin 71*a* that opens and closes the first side hook 70R and the second side hook 70L.

The opening-closing pin 71*a* is inserted into an opening-closing guide hole 73 provided in the first side hook 70R and the second side hook 70L. The opening-closing guide hole 73 extends along a moving direction of the sleeve 71, and has a shape that converts a linear movement of the opening-closing pin 71*a* moving in conjunction with the sleeve 71 into the opening-closing operation caused by the rotation of the first side hook 70R and the second side hook 70L with the shaft 71*b* serving as a fulcrum.

In the wire locking body 70, when the sleeve 71 moves in a rearward direction indicated by the arrow R1, the first side hook 70R and the second side hook 70L move in a direction away from the center hook 70C by a rotation operation with the shaft 71*b* serving as a fulcrum according to the trajectory of the opening-closing pin 71*a* and the shape of the opening-closing guide hole 73.

Accordingly, the first side hook 70R and the second side hook 70L are opened relative to the center hook 70C, and a feed path through which the wire W passes is formed between the first side hook 70R and the center hook 70C and between the second side hook 70L and the center hook 70C.

When the sleeve 71 moves to a region where the sleeve 71 does not rotate and the first side hook 70R and the second side hook 70L are opened relative to the center hook 70C, the wire W fed by the wire feeding unit 3 passes between the center hook 70C and the first side hook 70R. The wire W that passes between the center hook 70C and the first side hook 70R is guided to the curl forming unit 5. Then, the wire W is curled by the curl forming unit 5 and guided to the binding unit 7, and passes between the center hook 70C and the second side hook 70L.

In the wire locking body 70, when the sleeve 71 moves in a forward direction indicated by an arrow F1, the first side hook 70R and the second side hook 70L move in a direction approaching the center hook 70C by a rotation operation with the shaft 71*b* serving as a fulcrum due to the trajectory of the opening-closing pin 71*a* and the shape of the opening-closing guide hole 73. Accordingly, the first side hook 70R and the second side hook 70L are closed relative to the center hook 70C.

When the first side hook 70R is closed relative to the center hook 70C, the wire W sandwiched between the first side hook 70R and the center hook 70C is locked so as to be movable along an extending direction between the first side hook 70R and the center hook 70C. When the second side hook 70L is closed relative to the center hook 70C, the wire W sandwiched between the second side hook 70L and the center hook 70C is locked so as not to come off from between the second side hook 70L and the center hook 70C.

The wire locking body 70 includes a bent portion 71*c*1 by which the wire W is formed into a predetermined shape by pressing and bending a distal end side, which is one end portion of the wire W, in a predetermined direction. In addition, the wire locking body 70 includes a bent portion 71*c*2 by which the wire W is formed into a predetermined shape by pressing and bending a terminal end side, which is the other end portion of the wire W cut by the cutting unit 6, in a predetermined direction.

The sleeve 71 has a shape in which an end portion in the forward direction indicated by the arrow F1 is divided into two portions with the center hook 70C interposed between the first side hook 70R and the second side hook 70L, and a bent portion 71*c*1 is formed at an end portion in the forward direction located on the upper side in the non-rotating region, and a bent portion 71*c*2 is formed at an end portion in the forward direction located on the lower side.

After the wire W is cut by the cutting unit 6, the sleeve 71 further moves in the forward direction indicated by the arrow F1, so that the distal end side of the wire W locked by the center hook 70C and the second side hook 70L is pressed by the bent portion 71*c*1 and bent toward a reinforcing bars S side. In the sleeve 71, the terminal end side of the wire W, which is locked by the center hook 70C and the first side hook 70R and cut by the cutting unit 6, is pressed by the bent portion 71*c*2 and bent toward the reinforcing bars S side.

When the sleeve 71 further moves forward after the distal end side and the terminal end side of the wire W are bent toward the reinforcing bars S side, the sleeve 71 rotates in conjunction with the rotation shaft 72, and the wire W locked by the wire locking body 70 is twisted.

A rear end, which is the other end portion, of the rotation shaft 72 is coupled to the reduction gear 81 via a coupling portion 72*b* that is rotatable integrally with the reduction gear 81 and can move in the axial direction relative to the reduction gear 81. The coupling portion 72*b* includes a spring 72*c* that biases the rotation shaft 72 rearward, which is a direction approaching the reduction gear 81, and regulates a position of the rotation shaft 72 along the axial direction. Accordingly, the rotation shaft 72 can move forward, which is a direction away from the reduction gear 81 while receiving a reward pushing force of the spring 72*c*. Therefore, when a force for moving the wire locking body 70 forward along the axial direction is applied in the operation of binding the reinforcing bars S with the wire W, the rotation shaft 72 moves forward while receiving a force for pushing the rotation shaft 72 rearward by the spring 72*c*, so that the binding can be performed so that the wire W is in close contact with the reinforcing bars S.

In the reinforcing bar binding machine 1, the curl guide 50 and the leading guide 51 of the curl forming unit 5 described above are provided at an end portion on the front side of the body portion 10, which is one side along the axial direction of the rotation shaft 72.

Figure 5A:
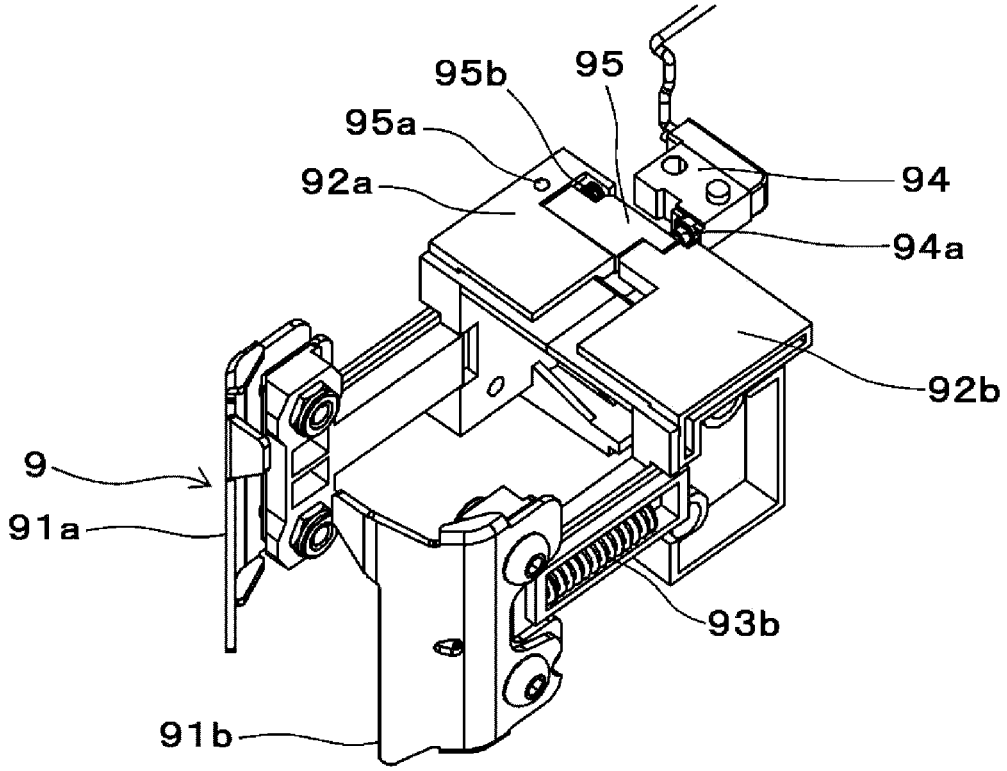
FIG. 5A is a perspective view illustrating an example of a contact switch unit according to the present embodiment.
Figure 5B:
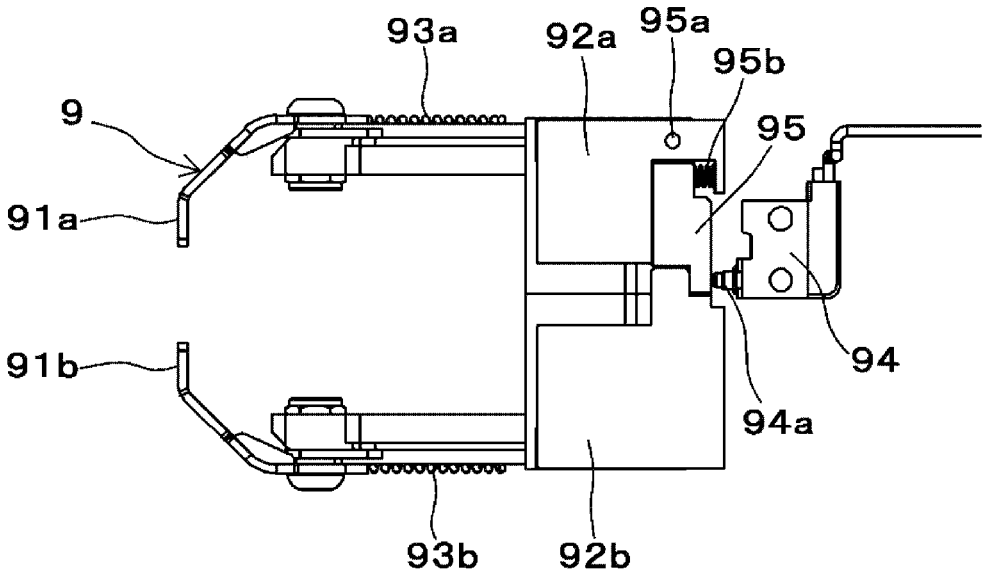
FIG. 5B is a top view illustrating an example of the contact switch unit according to the present embodiment.
Figure 5C:
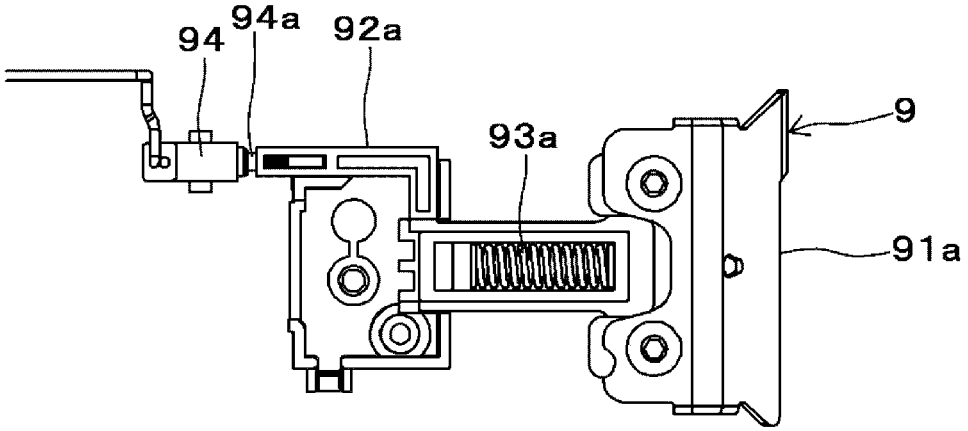
FIG. 5C is a side view illustrating an example of the contact switch unit according to the present embodiment.
Figure 5D:
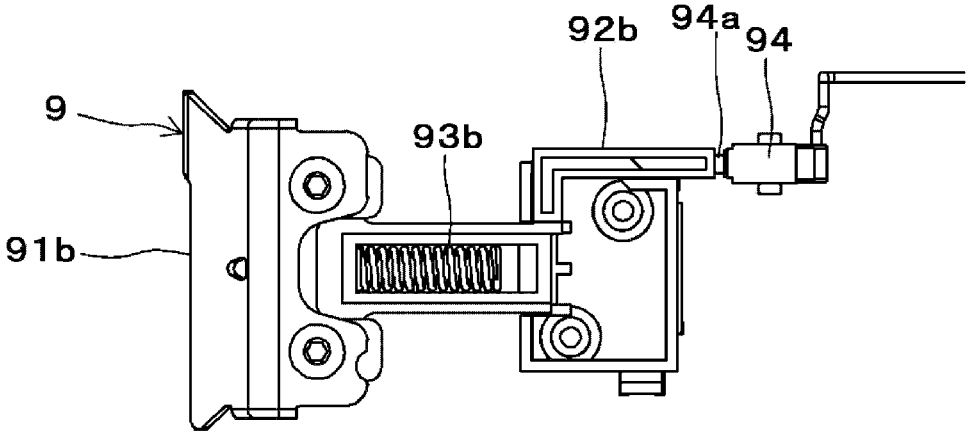
FIG. 5D is a side view illustrating an example of the contact switch unit according to the present embodiment.
Figure 5E:
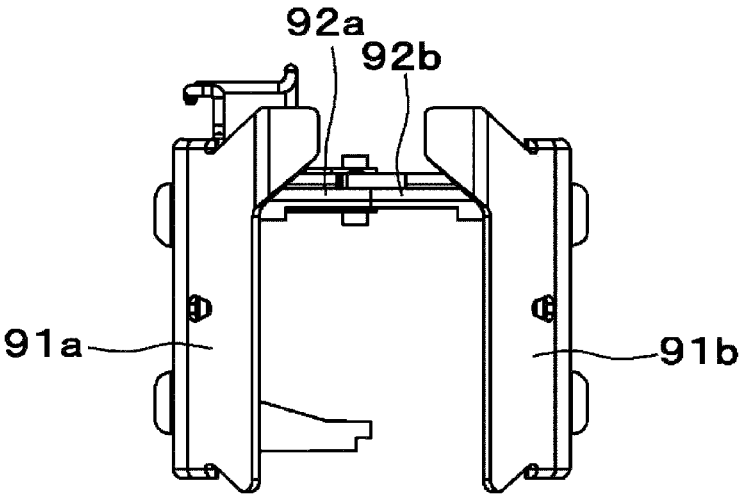
FIG. 5E is a front view illustrating an example of the contact switch unit according to the present embodiment.
Figure 6A:
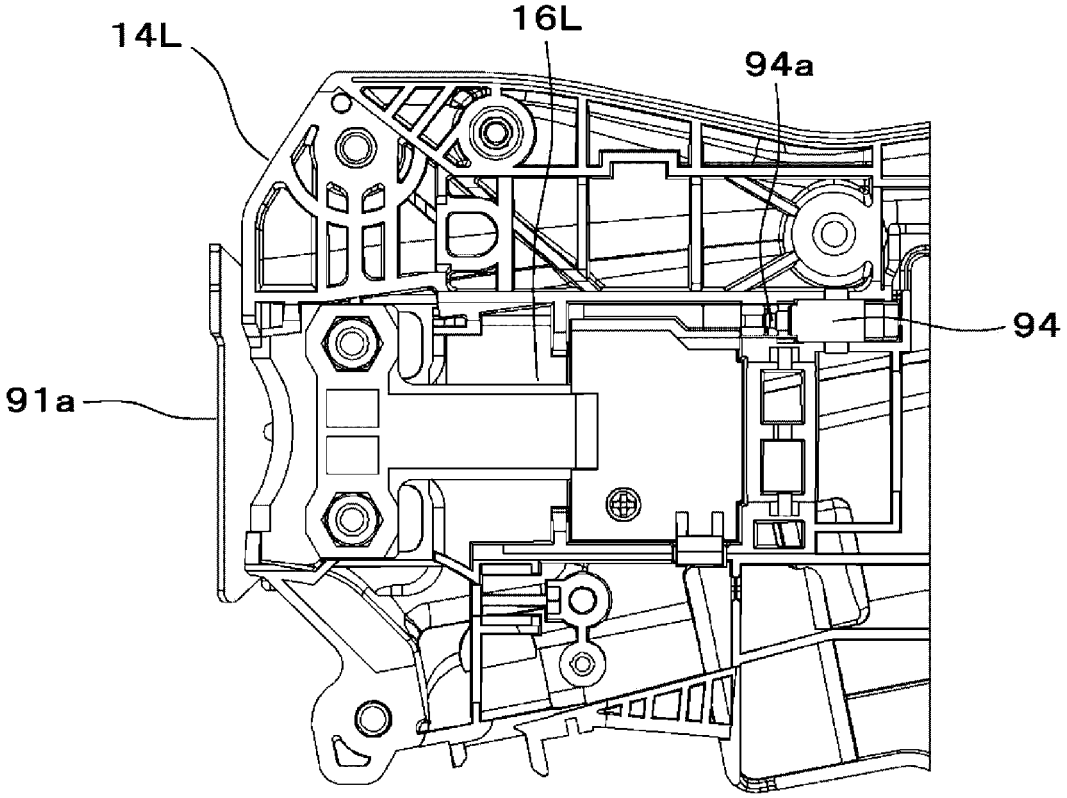
FIG. 6A is a side view of a main part, which illustrates an example of an attachment structure of the contact switch unit according to the present embodiment.
Figure 6B:
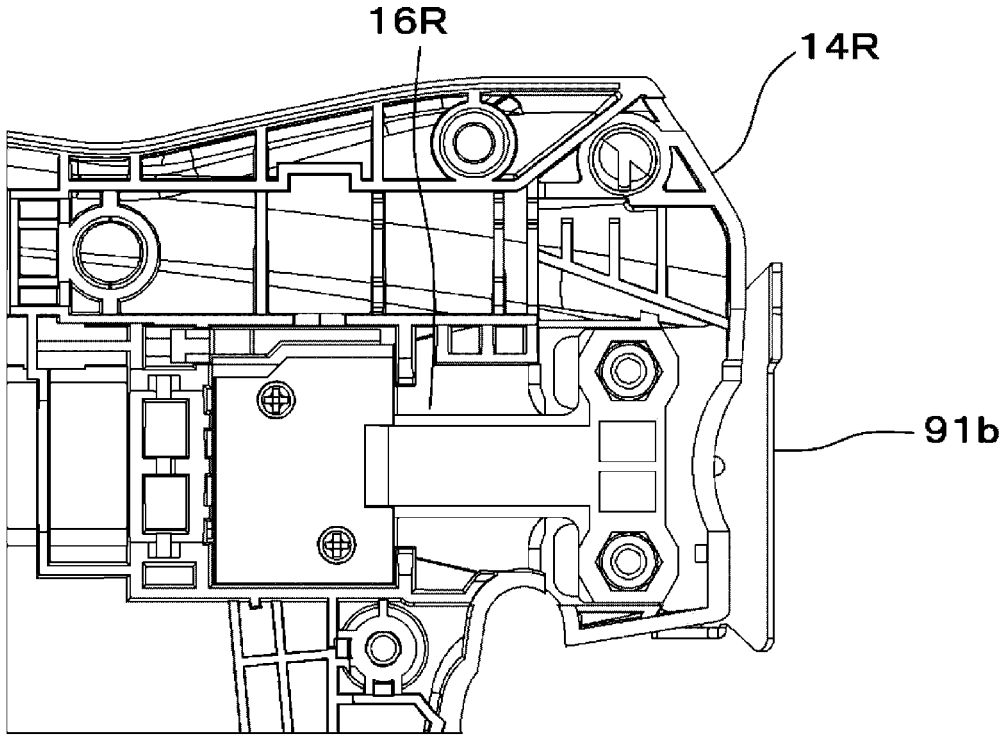
FIG. 6B is a side view of a main part, which illustrates an example of an attachment structure of the contact switch unit according to the present embodiment.

FIG. 5A is a perspective view illustrating an example of the contact switch unit according to the present embodiment, FIG. 5B is a top view illustrating an example of the contact switch unit according to the present embodiment, FIGS. 5C and 5D are side views illustrating an example of the contact switch unit according to the present embodiment, and FIG. 5E is a front view illustrating an example of the contact switch unit according to the present embodiment. FIGS. 6A and 6B are side views of main parts, which illustrate examples of attachment structures of the contact switch unit according to the present embodiment.

The contact switch unit 9 includes a pair of abutting portions 91 (a first abutting portion 91*a* and a second abutting portion 91*b*) against which the reinforcing bars S abut. In order to cause the reinforcing bars S inserted between the curl guide 50 and the leading guide 51 to abut against the abutting portion 91, the abutting portion 91 does not protrude from a front end position PF of the leading guide 51 whose protruding amount from the body portion 10 is small in the curl guide 50 and the leading guide 51, and is provided between the curl guide 50 and the leading guide 51 at the end portion on the front side of the body portion 10.

The abutting portion 91 is provided on at least one side along an axis L of a rotation operation of the binding unit 7 for performing binding by locking the wire W and twisting the locked wire W via rotation of the wire locking body 70, that is, an arrow L2-R2 direction that is a left-right direction perpendicular to a direction in which the curl guide 50 and the leading guide 51 are arranged relative to an extension line of an axial center of the rotation shaft 72. In this example, the first abutting portion 91*a* is provided on one side (left side when viewed from the front) along the arrow L2-R2 direction, and the second abutting portion 91*b* is provided on the other side (right side when viewed from the front).

The first abutting portion 91*a* and the second abutting portion 91*b* extend along the direction in which the curl guide 50 and the leading guide 51 are arranged, and the reinforcing bars S inserted between the curl guide 50 and the leading guide 51 can be brought into contact with at least one of the first abutting portion 91*a* and the second abutting portion 91*b* on an extension line of the axis L of the rotation operation of the binding unit 7.

Further, the abutting portion 91 (the first abutting portion 91*a*, the second abutting portion 91*b*) is configured such that a protruding amount L11 from a front end position PF1 that is one end portion of the body portion 10 to a front end position PF2 protruding along the axis L is smaller than a protruding amount L12 from the front end position PF1 of the body portion 10 to the front end position PF of the curl guide 50 and the leading guide 51 protruding along the axis L.

In this example, as for the leading guide 51 of the curl guide 50 and the leading guide 51, the protruding amount from the front end position PF1 of the body portion 10 is smaller. Therefore, the abutting portion 91 (the first abutting portion 91*a*, the second abutting portion 92*b*) is configured such that the protruding amount L11 of a part protruding to the maximum, among parts protruding along the axis L, from the front end position PF1 of the body portion 10 is smaller than the protruding amount L12 from the front end position PF1 of the body portion 10 to the front end position PF of the leading guide 51 protruding along the axis L.

Accordingly, the front end position PF2, protruding along the axis L, of the abutting portion 91 (the first abutting portion 91*a*, the second abutting portion 92*b*) does not protrude relative to the front end position PF of the leading guide 51, which has a small protruding amount from the body portion 10, of the curl guide 50 and the leading guide 51. Therefore, it is possible to prevent a structure located further forward than the front end positions of the curl guide 50 and the leading guide 51 from coming into contact with the abutting portion 91 and operating the abutting portion 91.

The contact switch unit 9 includes a pair of moving members 92 (a first moving member 92*a*, a second moving member 92*b*) that support the first abutting portion 91*a* and the second abutting portion 91*b* such that the first abutting portion 91*a* and the second abutting portion 91*b* are independently movable in the front-rear direction along the axis L of the rotation operation of the binding unit 7. The contact switch unit 9 further includes a pair of biasing members 93 (a first biasing member 93*a*, a second biasing member 93*b*) that independently bias the first butting portion 91*a* and the second butting portion 91*b* in the forward direction.

The body portion 10 has a configuration that is divided into left and right parts when viewed from the front and in which one case 14L and the other case 14R can be assembled integrally with screws. The first abutting portion 91*a* is attached to the one case 14L constituting the body portion 10 via the first moving member 92*a*. The case 14L includes, at a front end portion thereof, a support portion 16L that supports the first moving member 92*a* such that the first moving member 92*a* is movable along the front-rear direction. The first moving member 92*a* to which the first abutting portion 91*a* is attached is supported by the support portion 16L of the case 14L in a state in which the first moving member 92*a* is movable in the front-rear direction. Accordingly, the first abutting portion 91*a* is supported by the front end portion of the body portion 10 such that the first abutting portion 91*a* is movable in a linear direction along the axis L of the rotation operation of the binding unit 7.

The first biasing member 93*a* includes, for example, a coil spring, and biases the first moving member 92*a*, which is supported by the support portion 16L of the case 14L in a state of being movable in the front-rear direction, in the forward direction. Accordingly, the first abutting portion 91*a* is biased in a direction in which the first butting portion 91*a* protrudes forward from the front end portion of the body portion 10. When the first abutting portion 91*a* receives a rearward pushing force, the first abutting portion 91*a* moves rearward while compressing the first biasing member 93*a*.

The first abutting portion 91*a* is biased by the first biasing member 93*a* and protrudes forward from the front end portion of the body portion 10 to reach a first position, and the first position is referred to as an initial position P1. The first abutting portion 91*a* is moved rearward by a predetermined amount to reach a second position while compressing the first biasing member 93*a*, and the second position is referred to as a binding position P2.

The second butting portion 91*b* is attached to the other case 14R constituting the body portion 10 via the second moving member 92*b*. The case 14R includes, at a front end portion thereof, a support portion 16R that supports the second moving member 92*b* such that the second moving member 92*b* is movable along the front-rear direction. The second moving member 92*b* to which the second butting portion 91*b* is attached is supported by the support portion 16R of the case 14R in a state in which the second moving member 92*b* is movable in the front-rear direction. Accordingly, the second butting portion 91*b* is supported by the front end portion of the body portion 10 such that the second butting portion 91*b* is movable in the linear direction independently of the first butting portion 91*a*.

The second biasing member 93*b* includes, for example, a coil spring, and biases the second moving member 92*b*, which is supported by the support portion 16R of the case 14R in a state of being movable in the front-rear direction, in the forward direction. Accordingly, the second abutting portion 91*b* is biased in a direction in which the second abutting portion 91*b* protrudes forward independently of the first abutting portion 91*a* from the front end portion of the body portion 10. When the second abutting portion 91*b* receives a rearward pushing force, the second abutting portion 91*b* moves rearward while compressing the second biasing member 93*b*.

The second abutting portion 91*b* is biased by the second biasing member 93*b* and protrudes forward from the front end portion of the body portion 10 to reach a first position, and the first position is referred to as the initial position P1. The second abutting portion 91*b* is moved rearward by a predetermined amount to reach the second position while compressing the second biasing member 93*b*, and the second position is referred to as the binding position P2.

The contact switch unit 9 includes a detection unit 94 that detects whether the first abutting portion 91*a* and the second abutting portion 91*b* are activated, and a transmission member 95 that transmits a movement of the first abutting portion 91*a* and the second abutting portion 91*b* to the detection unit 94.

The detection unit 94 includes, for example, a switch referred to as a micro switch, and an output thereof changes when a movable element 94*a* is pressed by a predetermined amount. The detection unit 94 is attached to the one case 14R in a direction in which a moving direction of the movable element 94*a* is the front-rear direction. The detection unit 94 may be a switch or a sensor other than the microswitch, or may be a non-contact sensor such as a Hall sensor or an optical sensor.

The transmission member 95 is rotatably attached via a shaft 95*a* to the first moving member 92*a* to which the first abutting portion 91*a* is attached. The transmission member 95 moves in the front-rear direction together with the first moving member 92, and is displaced relative to the first moving member 92*a* by a rotating operation with the shaft 95*a* serving as a fulcrum. An end portion of the transmission member 95, opposite to an end portion supported by the shaft 95*a*, which is displaced by the rotational operation with the shaft 95*a* serving as a fulcrum, faces the movable element 94*a* of the detection unit 94.

The end portion of the transmission member 95 on a side opposite to a side supported by the shaft 95*a* is engaged with the second moving member 92*b* to which the second abutting portion 91*b* is attached. The transmission member 95 is biased by a biasing member 95*b* such as a coil spring in a direction in which the end portion on a side opposite to the side supported by the shaft 95*a* is pressed against the second moving member 92*b*.

Accordingly, when the first butting portion 91*a* is pushed rearward and the first moving member 92*a* moves rearward, the transmission member 95 moves rearward together with the first moving member 92*a* and pushes the movable element 94*a* of the detection unit 94.

When the second abutting portion 91*b* is pushed rearward and the second moving member 92*b* moves rearward, the transmission member 95 rotates with the shaft 95*a* serving as a fulcrum while compressing the biasing member 95*b*, and pushes the movable element 94*a* of the detection unit 94.

The first abutting portion 91*a* and the second abutting portion 91*b* may move by the rotation operation such that the moving direction of the first abutting portion 91*a* and the second abutting portion 91*b* is drawn as an arc in the front-rear direction along the axis L of the rotation operation of the binding unit 7.

The trigger switch unit 12 includes a trigger 13*a* that can be displaced in the front-rear direction by the operation of a finger on a front side, which is one side of the handle portion 11 gripped by the hand. In addition, the trigger switch unit 12 includes a switch 13*b* that detects whether the trigger 13*a* is activated inside the handle portion 11.

The reinforcing bar binding machine 1 includes a control unit 100 that executes a binding operation depending on whether the contact switch unit 9 and the trigger switch unit 12 are activated or not. When the trigger switch unit 12 is activated and the contact switch unit 9 is activated, the control unit 100 controls a feed motor (not illustrated) that drives the motor 80 and the feed gear 30 to perform a binding operation. When the contact switch unit 9 is activated in a state in which the trigger switch unit 12 is activated, the control unit 100 executes the binding operation. When the trigger switch unit 12 is activated in a state in which the contact switch unit 9 is activated, the control unit 100 may execute the binding operation. In addition, when the contact switch unit 9 is activated, the control unit 100 may execute the binding operation, and the trigger switch unit 12 may not be provided.

In the reinforcing bar binding machine 1, the handle portion 11 extends downward from the body portion 10. A battery 15 is detachably attached below the handle portion 11. In the reinforcing bar binding machine 1, the magazine 2 is provided in front of the handle portion 11. In the reinforcing bar binding machine 1, the wire feeding unit 3, the cutting unit 6, the binding unit 7, the drive unit 8 that drives the binding unit 7, the contact switch unit 9, the trigger switch unit 12, and the like described above are accommodated in the body portion 10.

In the reinforcing bar binding machine 1, the elements constituting the wire feeding unit 3, the curl forming unit 5, the cutting unit 6, the binding unit 7, and the drive unit 8, the first abutting portion 91*a*, the first moving member 92*a*, the first biasing member 93*a*, the detection unit 94, and the transmission member 95 constituting the contact switch unit 9, and the elements constituting the trigger switch unit 12 and the control unit 100 are attached to the one case 14L constituting the body portion 10. In the reinforcing bar binding machine 1, the second abutting portion 91*b*, the second moving member 92*b*, and the second biasing member 93*b* constituting the contact switch unit 9 are attached to the other case 14R constituting the body portion 10. Then, the one case 14L and the other case 14R are integrally assembled by screws or the like. Accordingly, the reinforcing bar binding machine 1 can be easily assembled.

Figure 7:
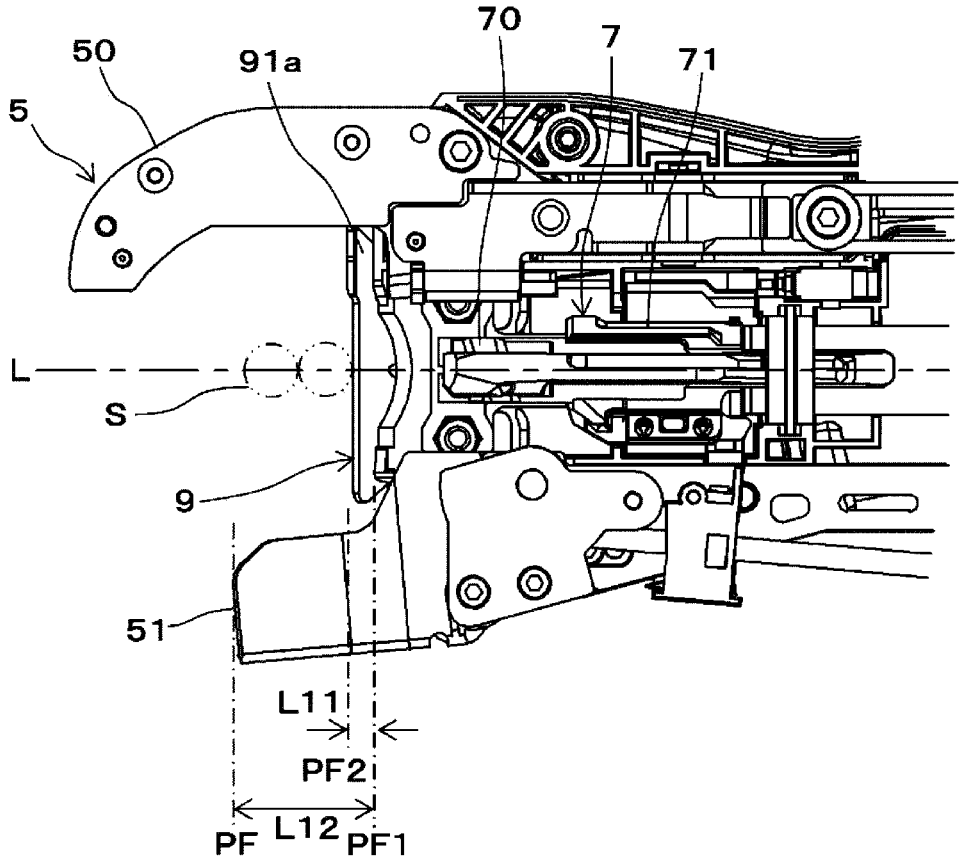
FIG. 7 is a side view of a main part, which illustrates an example of an operation of the reinforcing bar binding machine according to the present embodiment.

Operation Example of Reinforcing Bar Binding Machine According to Present Embodiment FIG. 7 is a side view of a main part, which illustrates an example of an operation of the reinforcing bar binding machine according to the present embodiment, FIGS. 8A to 8D are top views of a contact switch unit, which illustrate examples of operations of the reinforcing bar binding machine according to the present embodiment. Next, an operation of starting binding of the reinforcing bars S with the wire W in the reinforcing bar binding machine 1 according to the present embodiment will be described with reference to the drawings.

Figure 8A:
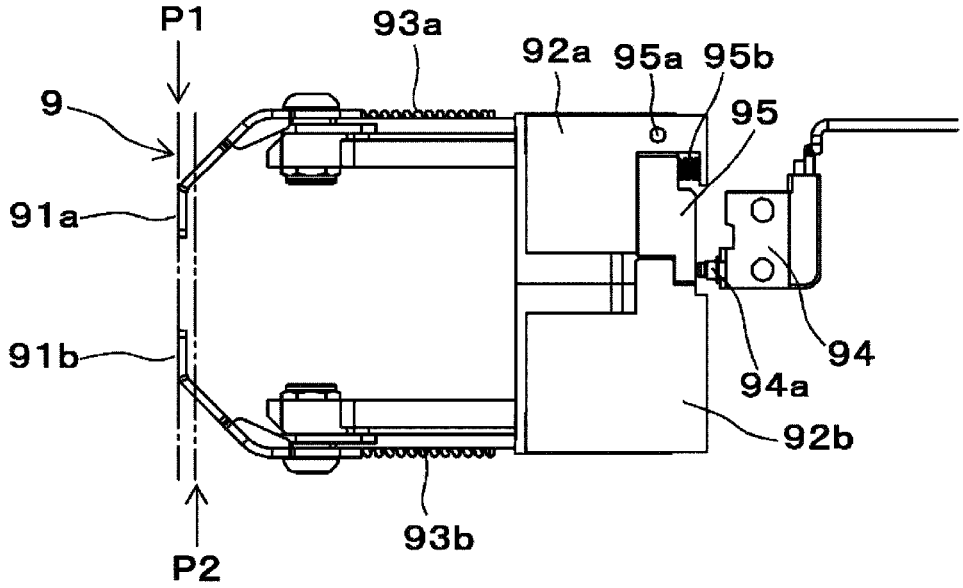
FIG. 8A is a top view of the contact switch unit, which illustrates an example of an operation of the reinforcing bar binding machine according to the present embodiment.

In a state in which the reinforcing bars S are not inserted between the curl guide 50 and the leading guide 51, the first abutting portion 91*a* moves to the initial position P1 where the first abutting portion 91*a* protrudes forward from the front end portion of the body portion 10 by being biased by the first biasing member 93*a*, and the second abutting portion 91*b* moves to the initial position P1 where the second abutting portion 91*b* protrudes forward from the front end portion of the body portion 10 by being biased by the second biasing member 93*b*, as illustrated in FIG. 8A. Accordingly, the movable element 94*a* of the detection unit 94 is not pushed, and both the first abutting portion 91*a* and the second abutting portion 91*b* are in a non-operating state.

In a state in which neither the first abutting portion 91*a* nor the second abutting portion 91*b* is in operation, the control unit 100 does not execute the binding operation even when the trigger switch unit 12 is activated.

As shown in FIG. 7, in an operation of inserting the reinforcing bars S between the curl guide 50 and the leading guide 51 of the curl forming unit 5, the reinforcing bars S come into contact with at least one of the first abutting portion 91*a* and the second abutting portion 91*b* on an extension line of the axis L of the rotation operation of the binding unit 7 or in a vicinity of the extension line.

Figure 8B:
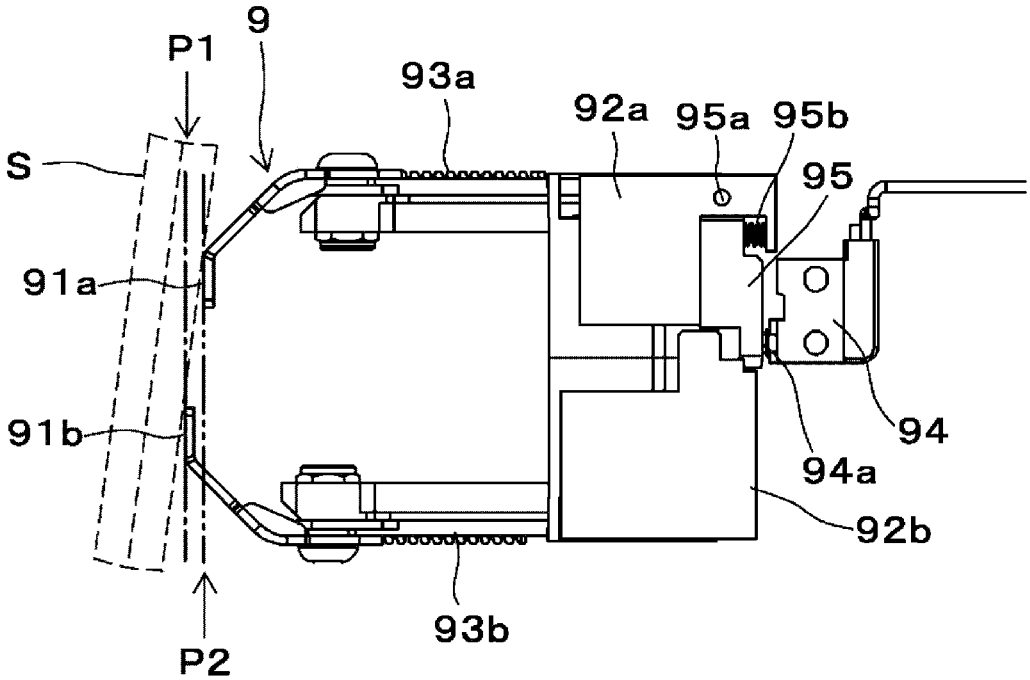
FIG. 8B is a top view of the contact switch unit, which illustrates an example of an operation of the reinforcing bar binding machine according to the present embodiment.

In a case where the reinforcing bars S are inclined relative to the reinforcing bar binding machine 1 in a direction in which the reinforcing bars S approach the first abutting portion 91*a* side, the first abutting portion 91*a* is pushed rearward by the reinforcing bars S, and the first moving member 92*a* moves rearward, as illustrated in FIG. 8B.

When the first moving member 92*a* moves rearward, the transmission member 95 moves rearward together with the first moving member 92*a* and pushes the movable element 94*a* of the detection unit 94. Then, when the first abutting portion 91*a* moves from the initial position P1 to the binding position P2, the movable element 94*a* is pushed by a predetermined amount, so that the output of the detection unit 94 is changed and the detection unit 94 detects that the first abutting portion 91*a* is activated.

Figure 8C:
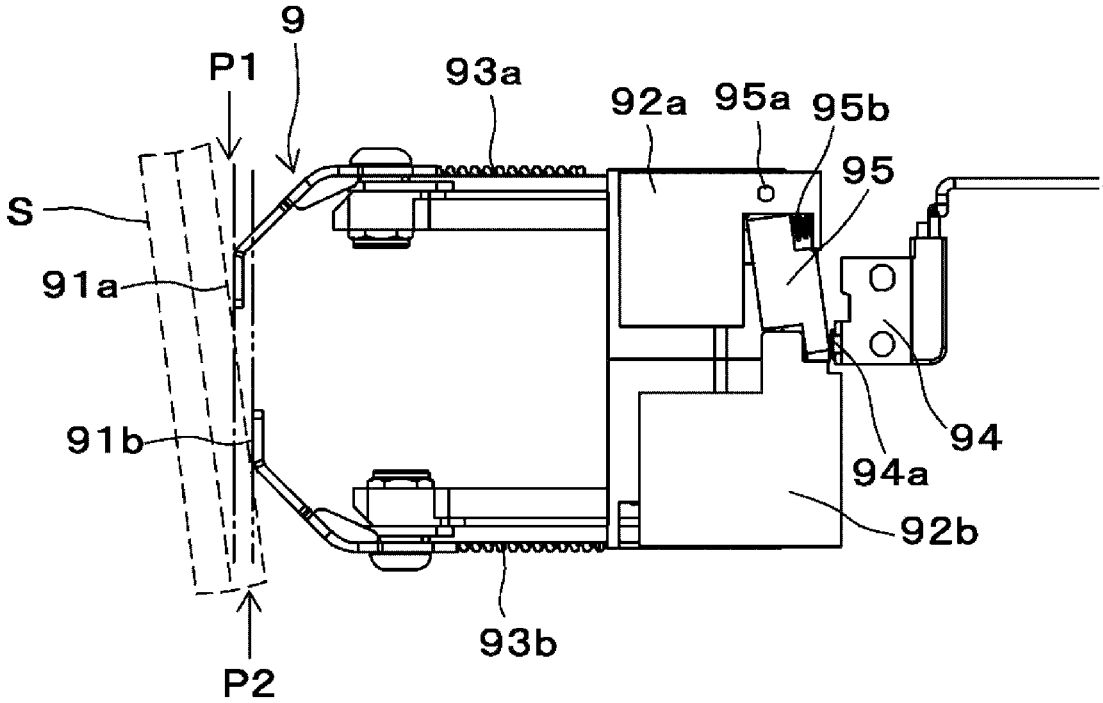
FIG. 8C is a top view of the contact switch unit, which illustrates an example of an operation of the reinforcing bar binding machine according to the present embodiment.

In a case where the reinforcing bars S are inclined relative to the reinforcing bar binding machine 1 in a direction in which the reinforcing bars S approach the second abutting portion 91*b* side, the second abutting portion 91*b* is pushed rearward by the reinforcing bars S, and the second moving member 92*b* moves rearward, as illustrated in FIG. 8C.

When the second moving member 92*b* moves rearward, the transmission member 95 rotates about the shaft 95*a* serving as a fulcrum while compressing the biasing member 95*b*, and pushes the movable element 94*a* of the detection unit 94. Then, when the second abutting portion 91*b* moves from the initial position P1 to the binding position P2, the movable element 94*a* is pushed by a predetermined amount, so that the output of the detection unit 94 is changed, and the detection unit 94 detects that the second abutting portion 91*b* is activated.

Figure 8D:
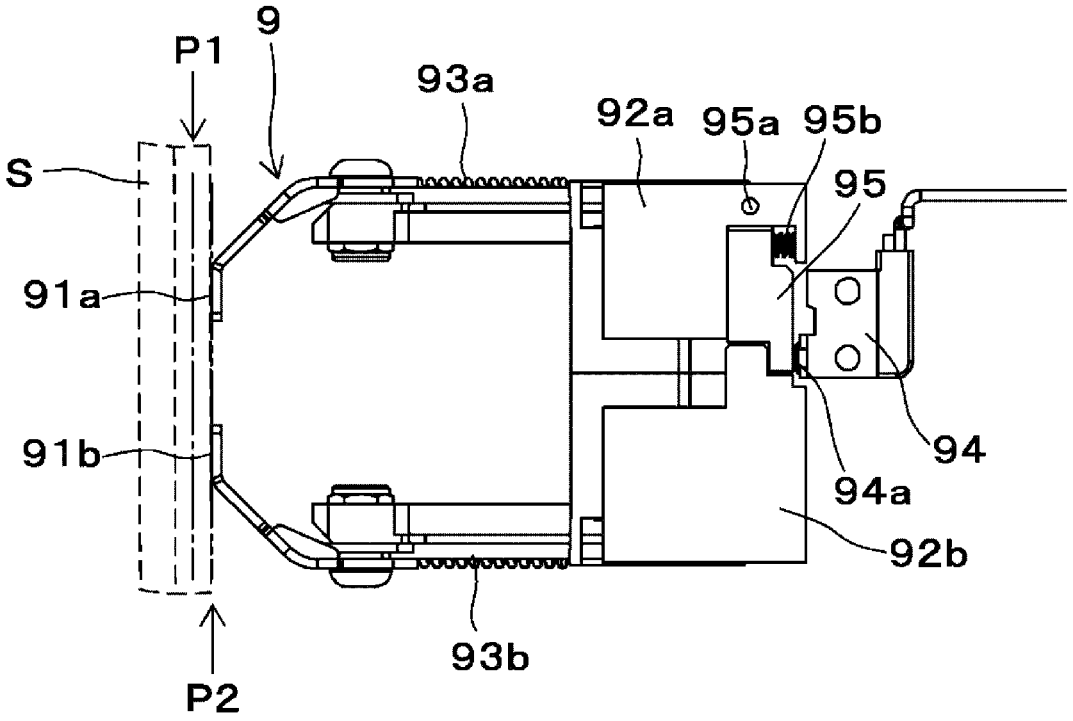
FIG. 8D is a top view of the contact switch unit, which illustrates an example of an operation of the reinforcing bar binding machine according to the present embodiment.

In a case where the reinforcing bars S are substantially parallel to the first abutting portion 91*a* and the second abutting portion 91*b*, the first abutting portion 91*a* is pushed rearward by the reinforcing bars S, and the first moving member 92*a* moves rearward, and at the same time, the second abutting portion 91*b* is pushed rearward, and the second moving member 92*b* moves rearward, as illustrated in FIG. 8D.

When the first moving member 92*a* and the second moving member 92*b* move rearward, the transmission member 95 moves rearward together with the first moving member 92*a* and pushes the movable element 94*a* of the detection unit 94. Then, when the first abutting portion 91*a* and the second abutting portion 91*b* move from the initial position P1 to the binding position P2, the movable element 94*a* is pushed by a predetermined amount, so that the output of the detection part 94 is changed, and the detection unit 94 detects that the first abutting portion 91*a* and the second abutting portion 91*b* are activated.

In a state in which the trigger switch unit 12 is activated, at least one of the first abutting portion 91*a* and the second abutting portion 91*b* moves rearward by a predetermined amount, the output of the detection unit 94 is changed, and thus it is detected that the contact switch unit 9 is activated. In this case, the control unit 100 controls the motor 80 and the feed motor (not illustrated) that drives the feed gear 30 to execute the binding operation. When the trigger switch unit 12 is activated in a state in which the contact switch unit 9 is activated, the control unit 100 may execute the binding operation. In addition, when the contact switch unit 9 is activated, the control unit 100 may execute the binding operation, and the trigger switch unit 12 may not be provided.

When the binding operation is started, the feed motor (not illustrated) is driven in a normal rotation direction, and the wire W is fed by the wire feeding unit 3 in the normal direction indicated by the arrow F0.

In the case of a configuration in which the reinforcing bars S are bound by a plurality of, for example, two wires W, the two wires W are fed by the wire guide 4 in a state of being arranged in parallel along the axial direction of the loop Ru formed by the wire W.

The wire W fed in the normal direction passes between the center hook 70C and the first side hook 70R and is fed to the curl guide 50 of the curl forming unit 5. The wire W is curled to be wound around the reinforcing bars S by passing through the curl guide 50.

The wire W curled by the curl guide 50 is guided by the leading guide 51 and further fed in the normal direction by the wire feeding unit 3, so that the wire W is guided between the center hook 70C and the second side hook 70L by the leading guide 51. Then, when the distal end of the wire W is fed to a predetermined position, the feeding of the wire W in the normal direction is stopped.

After the feeding of the wire W in the normal direction is stopped, the motor 80 is driven in the normal rotation direction. The sleeve 71 moves in a direction of the arrow F1, which is the forward direction, in an operation area where the wire W is locked by the wire locking body 70.

When the sleeve 71 moves forward, the opening-closing pin 71*a* passes through the opening-closing guide hole 73. Accordingly, the first side hook 70R moves in a direction approaching the center hook 70C by rotating about the shaft 71*b* serving as a fulcrum. When the first side hook 70R is closed relative to the center hook 70C, the wire W interposed between the first side hook 70R and the center hook 70C is locked so as to be movable along an extension direction between the first side hook 70R and the center hook 70C.

In addition, the second side hook 70L moves in a direction approaching the center hook 70C by rotating about the shaft 71*b* serving as a fulcrum. When the second side hook 70L is closed relative to the center hook 70C, the wire W interposed between the second side hook 70L and the center hook 70C is locked so as not to come off from between the second side hook 70L and the center hook 70C.

After the sleeve 71 is moved forward to a position where the wire W is locked by the closing operation of the first side hook 70R and the second side hook 70L, the rotation of the motor 80 is temporarily stopped, and the feed motor (not illustrated) is driven in the reverse rotation direction.

Accordingly, the pair of feed gears 30 are rotated in the reverse direction, and the wire W held between the pair of feed gears 30 is fed in the reverse direction indicated by the arrow R0. Since the distal end side of the wire W is locked so as not to come off from between the second side hook 70L and the center hook 70C, the wire W is wound around the reinforcing bars S by the operation of feeding the wire W in the reverse direction.

After the wire W is wound around the reinforcing bars S and the feeding of the wire W in the reverse direction is stopped, the motor 80 is driven in the formal rotation direction to further move the sleeve 71 in the forward direction indicated by the arrow F1.

When the movement of the sleeve 71 in the forward direction is transmitted to the cutting unit 6 by the transmission mechanism 62, the movable blade unit 61 rotates, and the wire W locked by the first side hook 70R and the center hook 70C is cut by the operations of the fixed blade portion 60 and the movable blade portion 61.

By driving the motor 80 in the forward rotation direction, the sleeve 71 is moved in the forward direction indicated by the arrow F1 to cut the wire W, and at substantially the same time, the bent portions 71*c*1 and 71*c*2 move in a direction approaching the reinforcing bars S. Accordingly, the distal end side of the wire W locked between the center hook 70C and the second side hook 70L is pressed toward the reinforcing bars S by the bent portion 71*c*1 and is bent toward the reinforcing bars S.

The terminal end side of the wire W locked between the center hook 70C and the first side hook 70R and cut by the cutting unit 6 is pressed toward the reinforcing bars S by the bent portion 71*c*2 and bent toward the reinforcing bars S.

After the distal end side and the terminal end side of the wire W are bent toward the reinforcing bars S, the motor 80 is further driven in the normal rotation direction, so that the sleeve 71 further moves in the forward direction. When the sleeve 71 moves to a predetermined position and reaches an operation area where the wire W locked by the wire locking body 70 is twisted, the sleeve 71 rotates in conjunction with the rotation shaft 72, and the wire W locked by the wire locking body 70 is twisted.

When it is detected that the load applied to the motor 80 is maximized by twisting the wire W, the normal rotation of the motor 80 is stopped. Next, when the motor 80 is driven in the reverse rotation direction, the rotation shaft 72 rotates in the reverse direction, and the sleeve 71 moves in the direction of the arrow R1, which is the rearward direction.

When the sleeve 71 moves rearward, the holding of the wire W is released. When the sleeve 71 moves rearward, the first side hook 70R moves in a direction away from the center hook 70C, and the second side hook 70L moves in a direction away from the center hook 70C. Accordingly, the wire W is removed from the wire locking body 70.

As described above, in the operation of inserting the reinforcing bars S between the curl guide 50 and the leading guide 51 of the curl forming unit 5, the reinforcing bars S come into contact with at least one of the first abutting portion 91*a* and the second abutting portion 91*b* on the extension line of the axis L of the rotation operation of the binding unit 7 or in the vicinity of the extension line. When at least one of the first abutting portion 91*a* and the second abutting portion 91*b* is pushed by the reinforcing bars S and moves rearward, the actuation of the contact switch unit 9 is detected, and in this case, the binding operation is executed.

Accordingly, the binding operation can be executed in a state in which the reinforcing bars S are positioned on or in the vicinity of the extension line of the axis L of the rotation operation of the binding unit 7. The moving direction of the first abutting portion 91*a* and the second abutting portion 91*b* is the front-rear direction along the axis L of the rotation operation of the binding unit 7, so that the positions of the reinforcing bars S are prevented from being largely deviated from the extension line of the axis L of the rotation operation of the binding unit 7 or the vicinity of the extension line even in the operation of activating the contact switch unit 9.

Therefore, the position of the reinforcing bars S is prevented from being largely deviated from the position where the wire W is twisted, and the binding strength can be ensured.

What is claimed is:

1. A binding machine, comprising:

a body portion, the body portion including:

a wire feeding unit configured to feed a wire to be wound around an object to be bound;

a binding unit configured to rotate while locking the wire wound around the object, whereby to twists the wire;

a curl guide configured to curl the wire fed by the wire feeding unit;

a leading guide configured to lead the wire, which is curled by the curl guide, to the binding unit; and a contact switch unit configured to be activated when the object abuts against the contact switch unit, wherein the curl guide and the leading guide are provided at one end portion of the body portion in a direction along an axis of a rotation operation of the binding unit, the contact switch unit includes an abutting portion against which the object abuts, the abutting portion is provided between the curl guide and the leading guide and is provided on at least one side relative to the axis in a direction perpendicular to both a direction in which the curl guide and the leading guide are arranged and the direction along the axis, a protruding amount from the one end portion of the body portion to a front end of the abutting portion along the axis is smaller than at least one of a protruding amount from the one end portion of the body portion to a front end of the curl guide along the axis and a protruding amount of the one end portion of the body portion to a front end of the leading guide along the axis, and a binding operation is executed in response to activation of the contact switch unit brought by abutment of the object against the abutting portion, wherein the abutting portion is moveable from a first position to a second position along the axis of the rotation operation of the binding unit, and when the abutting portion moves to the second position, the contact switch unit is activated, wherein the abutting portion includes a first abutting portion and a second abutting portion, the first abutting portion being on one side relative to the axis of the rotation operation of the binding unit in the direction perpendicular to both the direction in which the curl guide and the leading guide are arranged and the direction along the axis, and the second abutting portion being on the other side, and the first abutting portion and the second abutting portion are moveable independently of each other, the binding machine further comprising a detection unit configured to detect a movement of the first abutting portion and the second abutting portion; and a transmission member configured to transmit the movement of the first abutting portion and the second abutting portion to the single detection unit.

2. The binding machine according to claim 1, wherein the abutting portion is movably attached to a case constituting the body portion.

3. The binding machine according to claim 1, wherein the abutting portion is linearly moveable along the axis of the rotation operation of the binding unit.

4. The binding machine according to claim 1, wherein the abutting portion is rotationally moveable along an arc around the axis of the rotation operation of the binding unit.

5. The binding machine according to claim 1, wherein the protruding amount from the one end portion of the body portion to the front end of the abutting portion along the axis is smaller than a smaller one of the protruding amount from the one end portion of the body portion to the front end of the curl guide along the axis and the protruding amount from the one end portion of the body portion to the front end of the leading guide along the axis.

6. The binding machine according to claim 1, further comprising:

a handle portion protruding from the body portion; and a trigger switch unit configured to be activated by an operation of a hand gripping the handle portion, wherein the binding operation is executed in response to activation of the trigger switch unit and the contact switch unit.

* * * * *